US012577731B2

(12) United States Patent
Zhou et al.

(10) Patent No.: US 12,577,731 B2
(45) Date of Patent: Mar. 17, 2026

(54) STEEL CORD, PRODUCTION METHOD THEREOF, AND TIRE

(71) Applicant: Jiangsu Xingda Steel Tyre Cord Co., Ltd., Taizhou (CN)

(72) Inventors: Zhisong Zhou, Taizhou (CN); Shoupeng Kou, Taizhou (CN); Lili Yao, Taizhou (CN); Haidong Yao, Taizhou (CN); Zengguang Ke, Taizhou (CN)

(73) Assignee: Jiangsu Xingda Steel Tyre Cord Co., Ltd (CN)

( * ) Notice: Subject to any disclaimer, the term of this patent is extended or adjusted under 35 U.S.C. 154(b) by 0 days.

(21) Appl. No.: 18/699,233

(22) PCT Filed: Oct. 31, 2022

(86) PCT No.: PCT/CN2022/128486
§ 371 (c)(1),
(2) Date: Apr. 5, 2024

(87) PCT Pub. No.: WO2024/045308
PCT Pub. Date: Mar. 7, 2024

(65) Prior Publication Data

US 2025/0188677 A1 Jun. 12, 2025

(30) Foreign Application Priority Data

Aug. 31, 2022 (CN) ..... 202211051125.8

(51) Int. Cl.
*D07B 1/06* (2006.01)
*C21D 7/00* (2006.01)
*D07B 5/00* (2006.01)

(52) U.S. Cl.
CPC ..... *D07B 1/0646* (2013.01); *D07B 1/0693* (2013.01); *D07B 5/005* (2013.01);
(Continued)

(58) Field of Classification Search
CPC ..... D07B 1/0646; D07B 1/0693; D07B 5/005
See application file for complete search history.

(56) References Cited

U.S. PATENT DOCUMENTS 4,718,470 A * 1/1988 Kusakabe ..... B60C 9/0007 57/902
4,738,096 A * 4/1988 Hatakeyama ..... B60C 9/0057 57/902
4,938,015 A * 7/1990 Kinoshita ..... D07B 1/0646 57/902

(Continued)

FOREIGN PATENT DOCUMENTS

JP H05279974 A * 10/1993
JP H10259583 A * 9/1998
JP 2000129583 A * 5/2000 ..... B60C 9/0057

OTHER PUBLICATIONS

Translation of JP 2000129583.*
Translation of JP H10259583.*
Translation of JP H05279974.*

*Primary Examiner* — Shaun R Hurley

(57) ABSTRACT

A steel cord, a production method thereof, and a tire are provided. The steel cord is formed by twisting multiple steel wires, at least one of the steel wires is deformable to allow the cord to have an irregular surface morphology, and the irregular surface morphology is located at one or two symmetrical identical positions in an axial direction of the cord, such that a cross-section of the cord has a long axis and a short axis unequal to the long axis. The irregular surface morphology of the cord designed in the application is located at identical positions in the axial direction of the cord and destroys the uniform support state of steel wires in the circumferential direction of the cord, and it is difficult for the cord to maintain its original circular cross-section form in the subsequent stress relieving process, such that a flat cord can be produced.

16 Claims, 11 Drawing Sheets

(52) U.S. Cl.
CPC ..... *C21D 7/00* (2013.01); *D07B 2201/2007* (2013.01); *D07B 2205/3025* (2013.01); *D07B 2501/2046* (2013.01)

(56) References Cited

U.S. PATENT DOCUMENTS 5,223,060 A * 6/1993 Imamiya ..... D07B 1/062 57/902
5,319,915 A * 6/1994 Kobayashi ..... B60C 9/0007 57/902
5,351,470 A * 10/1994 Shinmura ..... D07B 1/0653 57/902
5,502,960 A * 4/1996 Kobayashi ..... B60C 9/0057 57/902
5,661,966 A * 9/1997 Matsumaru ..... D07B 7/025 57/212
5,707,467 A * 1/1998 Matsumaru ..... D07B 7/025 57/902
5,894,875 A * 4/1999 Masaki ..... B60C 9/0007 57/902
5,911,675 A * 6/1999 Obana ..... D07B 1/064 57/902
6,065,518 A * 5/2000 Miyawaki ..... B60C 9/0057 57/902
6,089,293 A * 7/2000 Niderost ..... B60C 9/22 152/526
6,308,508 B1 * 10/2001 Han ..... D07B 1/0646 428/592
6,311,466 B1 * 11/2001 De Vos ..... B60C 9/0064 428/592
7,434,381 B2 * 10/2008 Vaubourg ..... D07B 3/022 57/311
8,359,823 B2 * 1/2013 Qi ..... D07B 1/0626 57/212
8,387,353 B2 * 3/2013 Mullebrouck ..... D07B 7/025 57/237
8,966,872 B2 * 3/2015 Cheng ..... D07B 7/025 57/311
2016/0144663 A1 * 5/2016 Lee ..... B60C 9/0057 57/237
2020/0362486 A1 * 11/2020 Wang ..... D02G 3/48
2021/0309050 A1 * 10/2021 Cornille ..... B60C 9/0007

* cited by examiner (a)

(b)

(a)

(b)

STEEL CORD, PRODUCTION METHOD THEREOF, AND TIRE

FIELD

The invention relates to the technical field of steel cords, in particular to a steel cord, a production method thereof, and a tire.

BACKGROUND

Automobiles have high requirements for the properties of tires during the driving process, especially for the orientation of the cords of tire belts. Generally, in the radial direction of tires, steel cords are desired to have a smaller rigidity, a higher flexibility and better softness to provide good comfort when automobiles drive on uneven roads; and in the axial direction of the tires, the cords of the tire belts are designed to have a larger rigidity to reduce hysteresis when the tires make turns, so as to improve the steering performance and maneuverability of automobiles.

Conventional steel cords generally have the same properties in the circumferential direction and thus cannot satisfy the requirements for different properties of the tire belts. Cords with different properties in different directions have to be processed by specifical methods. U.S. Pat. No. 5,223,060A provides a flat steel cord with a 05 structure, which is manufactured by: producing a loose cord or a cord formed by steel wires having large gaps therebetween; and after rubber is adhered to the cord, performing rubber extrusion and filling to change the cross-section of the cord in the rubber until the cord is flat in the rubber. Such a cord is difficult to control, and the rubber extrusion and filling process is uncontrollable.

How to provide a cord which has a high rubber penetration rate and is easy to produce is an issue under study.

SUMMARY

The objective of the invention is to provide a steel cord, a production method thereof, and a tire to solve the problems of a low rubber penetration rate and an uncontrollable production process of flat cords in the prior art.

To fulfill the above objective, the invention adopts the following technical solution:

In a first aspect, the invention discloses a steel cord, which is formed by twisting multiple steel wires, wherein at least one of the steel wires is deformable to allow the cord to have an irregular surface morphology, and the irregular surface morphology is located at one or two symmetrical identical positions in an axial direction of the cord, such that a cross-section of the cord has a long axis and a short axis unequal to the long axis.

Further, the cord is a cord with a 1×n structure, a cord with a 1+n structure or a cord with a layered structure, and the number of steel wires in an outermost layer of the cord with the layered structure is n; wherein, n≥5.

Further, at least one of untwisted steel wires of the cord has a periodic complex waveform, and the complex waveform comprises a first waveform and a second waveform overlaid on the first waveform.

Further, in a projection of each of the untwisted steel wires within unit cord length on the cross-section, unsmooth curves produced by the second waveform are in a same direction.

Further, within unit twist pitch, the second waveforms of all the untwisted steel wires are sequentially arranged in the axial direction of the cord.

Further, all the untwisted steel wires of the cord have the periodic complex waveform.

Further, an angle of a projection of the irregular surface morphology on the cross-section of the cord ranges from 0° to 180°.

Further, the angle of the projection of the irregular surface morphology on the cross-section of the cord ranges from 0° to 120°.

Further, a ratio of the long axis to the short axis ranges from 1 to 1.546.

Further, the ratio of the long axis to the short axis ranges from 1 to 1.394.

In a second aspect, the invention discloses a production method of the steel cord in the first aspect, comprising:

periodically deforming steel wires to allow the steel wires to have periodic complex waveforms after being twisted by a stranding machine; and twisting at least one of the deformed steel wires and other steel wires to form the cord, wherein during the twisting process, the periodic waveforms of the steel wires are arranged at one or two symmetrical identical positions in an axial direction of the cord allow the cord to have an irregular surface morphology at the identical positions in the axial direction.

In a third aspect, the invention discloses a tire, comprising the steel cord in the first aspect.

Beneficial effects: the irregular surface morphology of the cord designed in the application is located at identical positions in the axial direction of the cord and destroys the uniform support state of steel wires in the circumferential direction of the cord, and it is difficult for the cord to maintain its original circular cross-section form in the subsequent stress relieving process, such that a flat cord, the cross-section of which has a long axis and a short axis unequal to the long axis, can be produced; in the application, the flat cord is produced by means of the irregular surface morphology, so the production process is controllable, and the flat cord can be produced easily; and the rubber penetration rate of the cord can be increased by allowing the irregular surface morphology to be located on one or two sides of the cord.

DETAILED DESCRIPTION

To gain a good understanding of the technical means, creative features, objectives and effects of the invention, the invention is further expounded below in conjunction with specific embodiments.

Embodiment 1

As shown in FIG. 1 to FIG. 10, a steel cord is formed by twisting multiple steel wires, wherein at least one of the steel wires is deformable to allow the cord to have an irregular surface morphology, and the irregular surface morphology is located at one or two symmetrical identical positions in an axial direction XY of the cord, such that a cross-section of the cord has a long axis and a short axis unequal to the long axis.

The irregular surface morphology of the cord designed in the application is located at identical positions in the axial direction of the cord and destroys the uniform support state of steel wires in the circumferential direction of the cord, and it is difficult for the cord to maintain its original circular cross-section form in the subsequent stress relieving process, such that a flat cord, the cross-section of which has a long axis and a short axis unequal to the long axis, can be produced; in the application, the flat cord is produced by means of the irregular surface morphology, so the production process is controllable, and the flat cord can be produced easily; and the rubber penetration rate of the cord can be increased by allowing the irregular surface morphology to be located on one or two sides of the cord.

Figure 4:
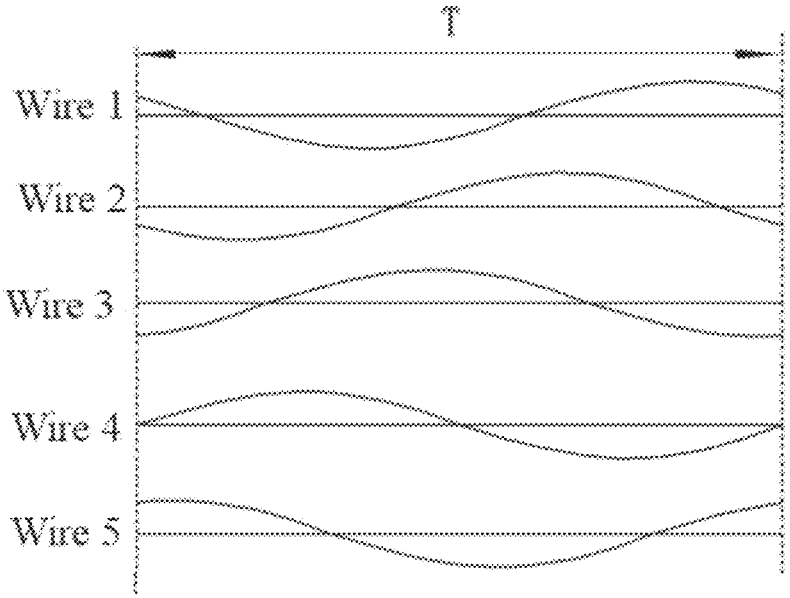
FIG. 4 is a schematic diagram of the morphology of untwisted steel wires within the last twist pitch of a conventional cord.

In some further embodiments, at least one of entwisted steel wires of the cord has a periodic second waveform, which is overlaid on a periodic first waveform, and as shown in FIG. 4, within one twist pitch, the second waveform and the first waveform may be referred to as a complex waveform. In a further embodiment, all the untwisted steel wires of the cord have the periodic second waveform. Untwisted steel wires of a conventional cord have only one waveform, and the distance between adjacent wave peaks or wave troughs is the twist pitch T of the cord.

Figure 8:
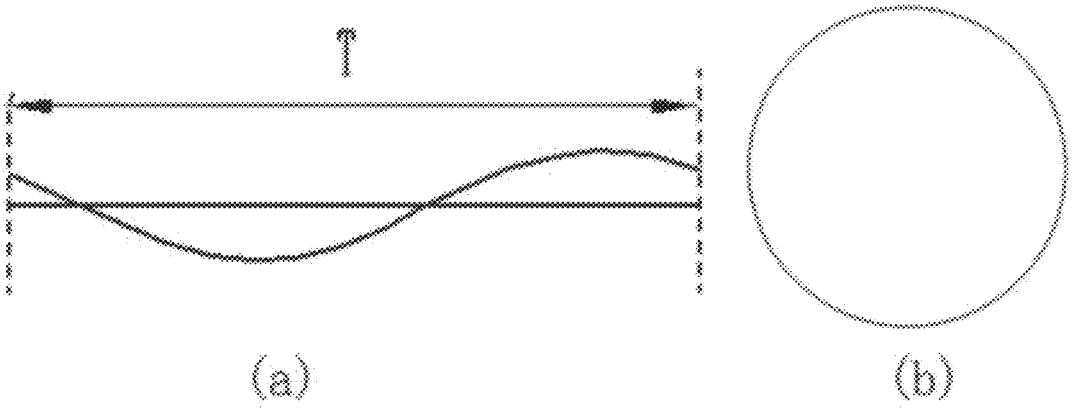
FIG. 8(*a*) and FIG. 8(*b*) are respectively a schematic diagram of the morphology of one untwisted steel wire of the conventional cord and a schematic diagram of the projection of the steel wire on the cross-section of the conventional cord.
Figure 9:
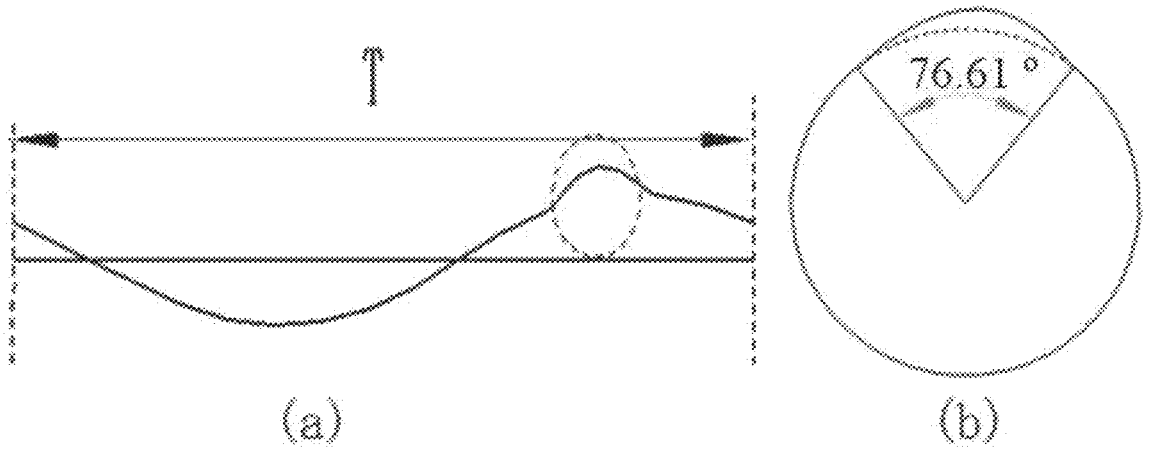
FIG. 9(*a*) and FIG. 9(*b*) are respectively a schematic diagram of the morphology of one untwisted steel wire of the cord and a schematic diagram of the projection of the steel wire on the cross-section of the cord according to the invention.

The irregular surface morphology of the cord and the projection of the irregular surface morphology on the cross-section of the cord are determined by the morphology of the second waveform of the steel wires of the cord. As shown in FIG. 8(*a*) and FIG. 8(*b*), the projection of untwisted steel wires in the conventional cord on the cross-section of the cord is a circle. The projection of untwisted steel wires in the cord on the cross-section of the cord in the invention is a circle with an unsmooth curve, as shown in FIG. 9(*a*) and FIG. 9(*b*).

Figure 3:
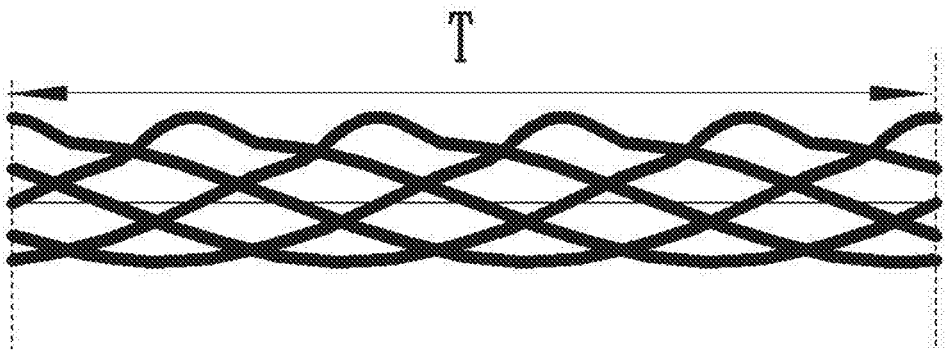
FIG. 3 is a side view of the cord with a 1×5 structure according to the invention.
Figure 10:
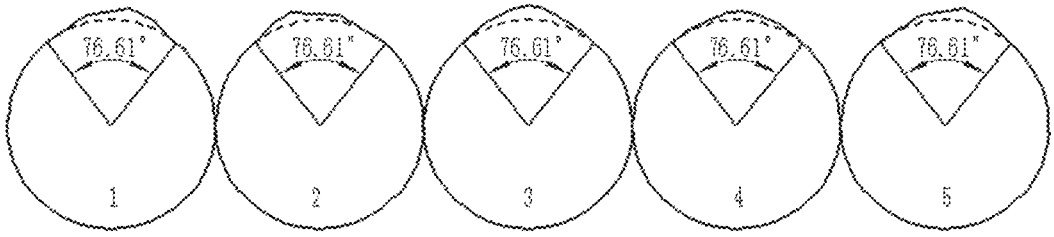
FIG. 10 is a schematic diagram of the projection of each untwisted steel wire on the cross-section of the cord with a 1×5 structure according to the invention.

According to the cord in the invention, within the unit cord length, the unsmooth curves of the projections of the untwisted steel wires on the cross-section are in the same direction. For example, for a cord with a 1×5 structure, the morphology of each untwisted steel wire within unit cord length is shown in FIG. 3, the morphology of the five untwisted steel wires is manifested as an irregular surface morphology on the surface of the cord, and the projection of each untwisted steel wire on the cross-section is shown in FIG. 10.

Figure 5:
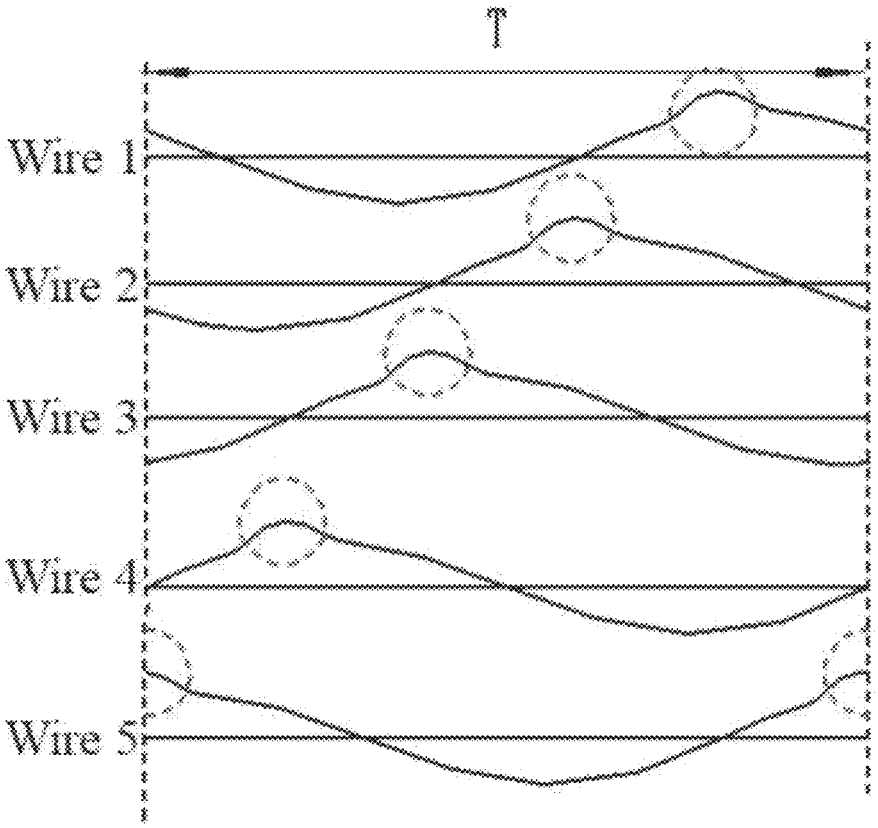
FIG. 5 is a schematic diagram of the morphology of untwisted steel wires within the last twist pitch of a cord according to the invention.

According to the cord in the invention, for the cord with a 1×5 structure, the second waveforms of all the untwisted steel wires within unit twist pitch are sequentially arranged in the axial direction of the cord, as shown in FIG. 5.

Figure 7:
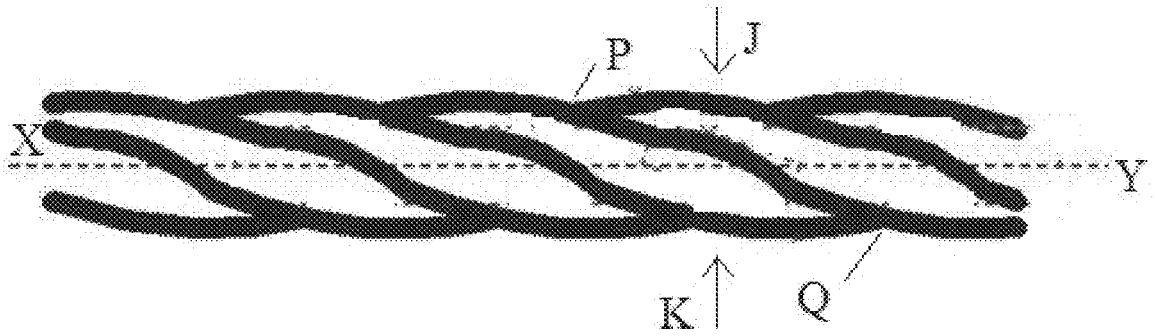
FIG. 7(*a*) and FIG. 7(*b*) are respectively a top view of an irregular surface morphology of a cord with a 1×6 structure and a morphometric diagram of the cross-section of the cord with a 1×6 structure according to the invention.
Figure 7:
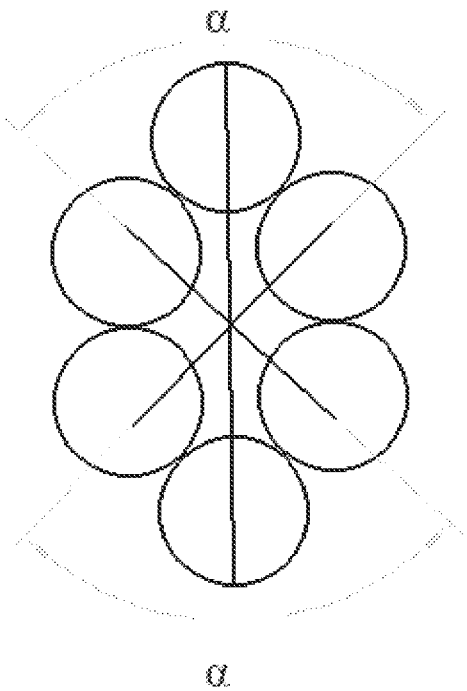

The cord in the invention may be a cord with a 1×n structure, a cord with a 1+n structure or a cord with a layered structure, and the number of steel wires in an outermost layer of the cord with the layered structure is n; wherein, n≥5. As shown in FIG. 7(*a*) and FIG. 7(*b*), the invention further provides a side view of a cord with a 1×6 structure and a morphometric diagram of the cross-section of the cord with a 1×6 structure.

Further, the angle of a projection of the irregular surface morphology on the cross-section of the cord ranges from 0° to 180°. Further, the angle of the projection of the irregular surface morphology on the cross-section of the cord ranges from 0° to 120°. In some embodiments where the cord has a 1×5 or 1+5 structure, the ratio of the long axis to the short axis of the cross-section of the cord ranges from 1 to 1.394. In some embodiments where the cord has a 1×6 or 1+6 structure, the ratio of the long axis to the short axis of the cross-section of the cord ranges from 1 to 1.46.

Figure 1:
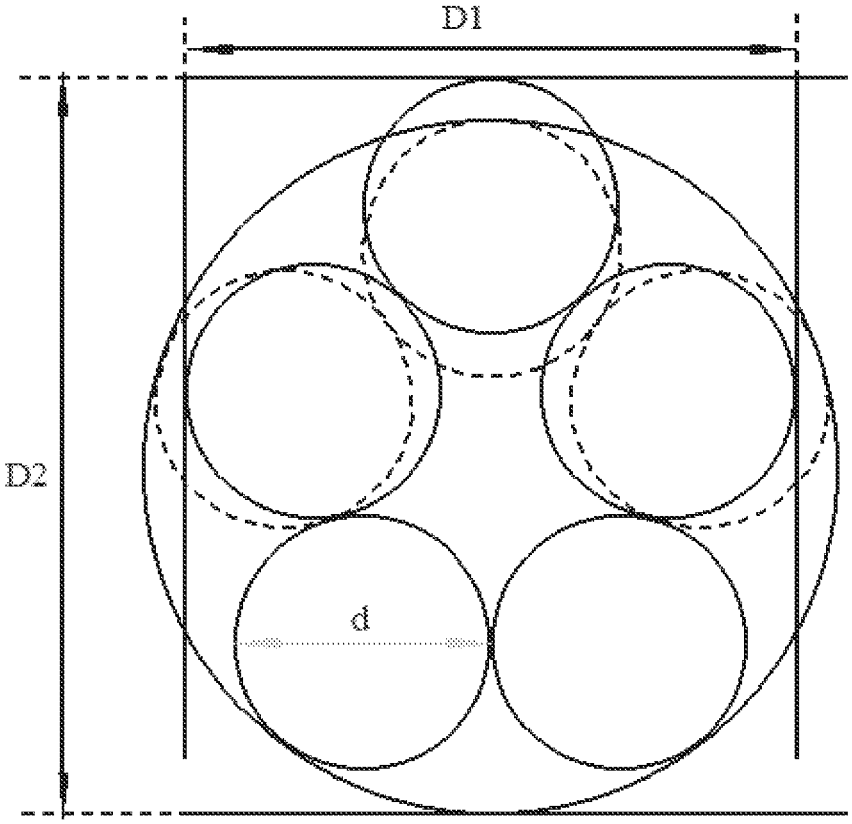
FIG. 1 is a morphometric diagram of one cross-section of a cord with a 1×5 structure according to the invention.
Figure 2:
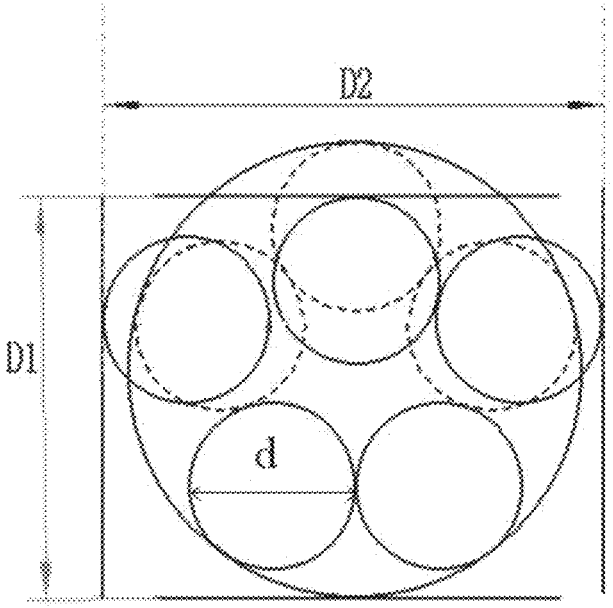
FIG. 2 is a morphometric diagram of another cross-section of the cord with a 1×5 structure according to the invention.

The cord with a 1×5 structure is described in detail. As shown in FIG. 1 or FIG. 2 which is a morphometric diagram of the cross-section of the cord with a 1×5 structure, the long axis of the cross-section of the cord is D2, the short axis of the cross-section of the cord is D1, and FIG. 3 is a side view of the cord in the invention. FIG. 5 is a schematic diagram of the morphology of untwisted steel wires within the last twist pitch of the flat cord according to the invention, and the position of the second waveform of each steel wire is indicated in FIG. 5. In actual cases, the second waveforms in the morphology of the untwisted steel wires are more complex.

In the application, the flat cord means that the cross-section of the cord has a long axis and a short axis different from the long axis.

Figure 6:
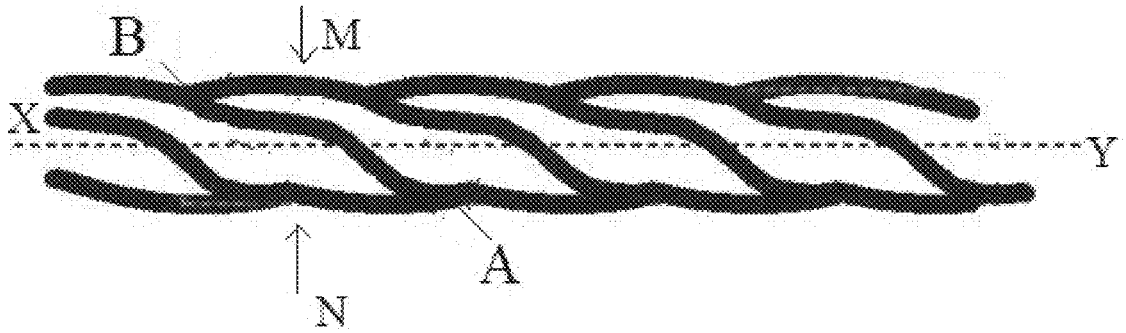
FIG. 6(*a*) and FIG. 6(*b*) are respectively a top view of an irregular surface morphology of the cord with a 1×5 structure and a morphometric diagram of the cross-section of the cord with a 1×5 structure according to the invention.
Figure 6:
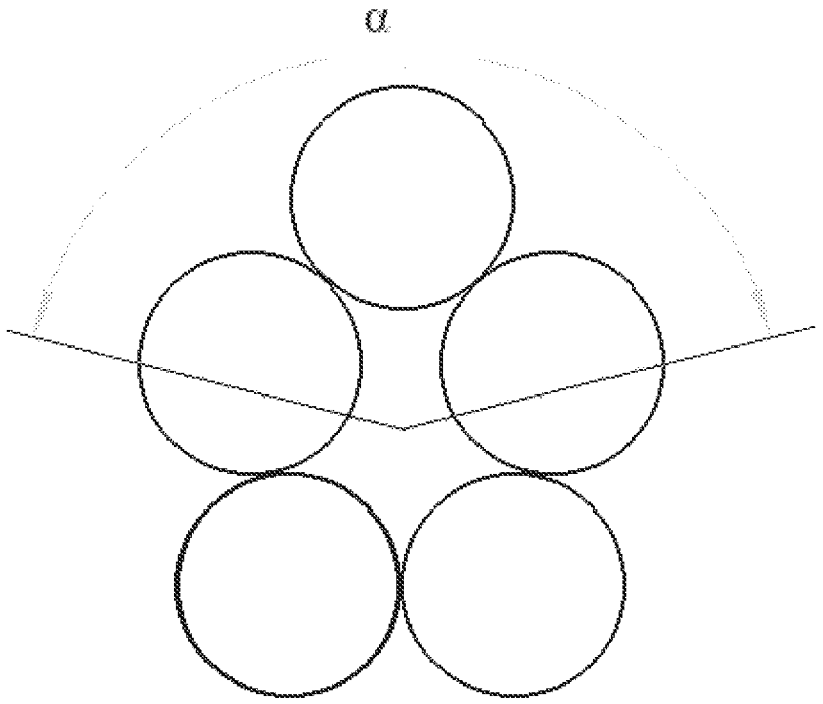

FIG. 6 (*a*) and FIG. 6 (*b*) illustrates a top view of the irregular surface morphology of a flat cord and a projection of the irregular surface morphology on the cross-section of the cord, and the projection of the irregular surface morphology is the projection of the length AB, which is the length of the curve from A to B, on the circumference of the cross-section "MN" in FIG. 6 (*a*). The projection angle $\alpha$ satisfies $0<\alpha<180°$, and the length AB is also the length of the second waveforms on the untwisted steel wires.

FIG. 7 (*a*) and FIG. 7 (*b*) illustrates a top view of the irregular surface morphology of a flat cord in another form and a projection of the irregular surface morphology on the cross-section of the cord, and the projection of the irregular surface morphology is the projection of the length PQ, which is the length of the curve from P to Q, on the circumference of the cross-section "JK" in FIG. 7 (*a*). The projection angle α satisfies 0<α<120°, and the length PQ is also the length of the second waveforms on the untwisted steel wires.

Figure 13:
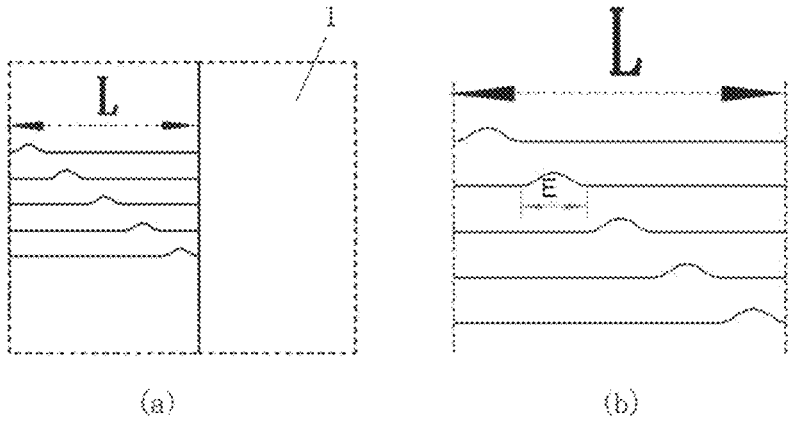
FIG. 13(*a*) and FIG. 13(*b*) are respectively a schematic diagram of a deformation device and an enlarged view of processed steel wires according to the invention.

The projection angle α is calculated as follows: as shown in FIG. 13(*a*) and FIG. 13(*b*), under the precondition of a certain tension which is generally 20% of the breaking force of the steels, the wavelength E of the waveforms of the steel wires after pre-deformation is measured, and α=360×E/L.

With a 1×5×0.30 flat cord as an example, steel wires with different periodic deformations before twisting can be obtained using different deformation gears, and the performance indicators of cords obtained after twisting are shown in Table 1.

TABLE 1

| | Comparative example 1 | Embodiment 1 | Embodiment 2 | Comparative example 2 | Embodiment 3 | Embodiment 4 |
|---|---|---|---|---|---|---|
| Specification | 5 × 0.30 | 5 × 0.30 | 5 × 0.30 | 5 × 0.30 | 5 × 0.30 | 5 × 0.30 |
| Long axis/short axis | 1.05 | 1.18 | 1.19 | 1.05 | 1.19 | 1.23 |
| Twist pitch mm | 12.5 | 12.5 | 12.5 | 16 | 16 | 16 |
| Pre-deformation period L | / | 12.6 | 12.6 | / | 16.1 | 16.1 |
| α° | / | 80 | 121.5 | / | 86 | 142 |
| Comparison of breaking loads | 100% | 90% | 98% | 100% | 96% | 100% |
| Ratio of bending rigidity in the long-axis direction to the bending rigidity in the short-axis direction after rubber adhesion | 1.0 | 1.35 | 1.30 | 1.0 | 1.29 | 1.33 |
| Rubber penetration rate % measured by the pressure drop method | 0 | 100% | 100% | 0 | 100% | 100% |
| Comparison of breaking elongation | 100% | 87% | 86% | 100% | 85% | 87% |

With a 1×6×0.30 flat cord as an example, steel wires with different periodic deformations before twisting can be obtained using different deformation gears, and the performance indicators of cords obtained after twisting are shown in Table 2.

TABLE 2

| | Comparative example 1 | Embodiment 1 | Embodiment 2 |
|---|---|---|---|
| Specification | 6 × 0.30 | 6 × 0.30 | 6 × 0.30 |
| Long axis/short axis | 1.05 | 1.35 | 1.40 |
| Twist pitch mm | 16 | 16 | 16 |
| Pre-deformation period L | / | 8.05 | 8.05 |
| α° | / | 78.5 | 118 |
| Comparison of breaking loads | 100% | 95% | 100% |
| Ratio of bending rigidity in the long-axis direction to the bending rigidity in the short-axis direction after rubber adhesion | 1.0 | 1.54 | 1.61 |
| Rubber penetration rate % measured by the pressure drop method | 0 | 100% | 100% |
| Comparison of breaking elongation | 100% | 86% | 87% |

It can be clearly seen, from Table 1 and Table 2, that compared with cords in the prior art, the cord in the invention shows good rubber penetration performance and discrepancy in bending rigidity in different directions of the cord. Although, there is a risk of reducing the strength of the cord, this risk can be avoided by corresponding approaches, for example, by adjusting the tooth form of deformation gears, increasing the wave height and length of deformed steel wires, reducing the bending radius of steel wires during periodic pre-deformation, so as to reduce a strength loss of pre-deformed steel wires after twisting. The increase of the pre-deformation wave length will increase the length AB of the irregular surface morphology of the cord after twisting (the section AB in FIG. 6), thus increasing the angle α. The breaking elongation of the cord provided by the application is reduced.

Still with the 1×5×0.30 flat cord as an example, the performance indicators of cords obtained by the production method in the invention are shown in Table 3.

TABLE 3

| | Comparative example | Embodiment |
|---|---|---|
| Specification | 5 × 0.30 | 5 × 0.30 |
| Long axis/short axis | 1.17 | 1.19 |
| Twist pitch mm | 18.2 | 18.3 |
| Pre-deformation period L | / | 18.2 |
| α° | / | 135 |
| Comparison of breaking loads | 100% | 98% |

TABLE 3-continued

| | Comparative example | Embodiment |
|---|---|---|
| Ratio of bending rigidity in the long-axis direction to the bending rigidity in the short-axis direction after rubber adhesion | 1.29 | 1.30 |
| Rubber penetration rate % measured by the pressure drop method | 100% | 100% |
| Comparison of breaking elongation | 100% | 95% |
| Comparison of adhesive and peeling force | 100% | 110% |

Data in Table 3 indicate that compared with flat cords in the prior art, the cord in the invention has a high adhesive and peeling force under the mechanical meshing effect of the irregular surface state of the cord.

Embodiment 2

The invention further discloses a production method of a steel cord. The production method comprises the following steps: periodically deforming steel wires to allow the steel wires to have periodic complex waveforms after being twisted by a stranding machine; and twisting at least one of the deformed steel wires and other steel wires to form the cord, wherein during the twisting process, the periodic waveforms of the steel wires are arranged at one or two symmetrical identical positions in an axial direction of the cord allow the cord to have an irregular surface morphology at the identical positions in the axial direction. The method can be used for producing the cord disclosed in Embodiment 1.

In the application, in the step of twisting at least one of the deformed steel wires and other steel wires to form the cord, the other steel wires may be steels which are periodically deformed in the application or steel wires not periodically deformed.

Further, periodically deforming steel wires refers to periodically deforming the steel wires in a length direction, and the periodic length is 0.5 L or L. Wherein, L is the length of untwisted steel wires of the cord.

Figure 11:
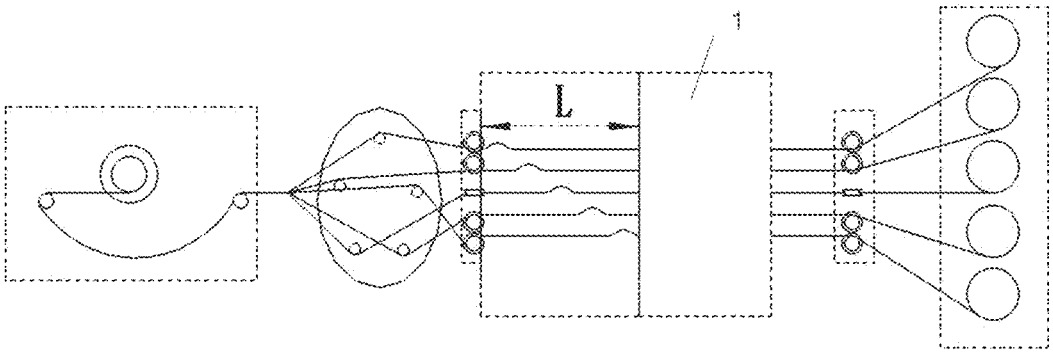
FIG. 11 is a schematic diagram of a production device used for producing the cord according to the invention.

In the invention, the steel wires are periodically deformed by means of a deformation device 1, part of tooth structures of which are arranged periodically, as shown in FIG. 11 and FIG. 13.

The range of the irregular morphology on the surface of the cord is controlled by the tooth form of the deformation device 1. When the tooth form is large, the length of the second waveform is large, and the angle of the projection of the deformed region on the cross-section of the cord is large. Similarly, when the tooth form is large, the curvature radius of the bending deformation of the steel wires is relatively large, so after the steel wires are twisted, the loss of the breaking force of the steel wires during the twisting process will not be increased, and the breaking force of the cord is basically the same as that of conventional cords.

Figure 14:
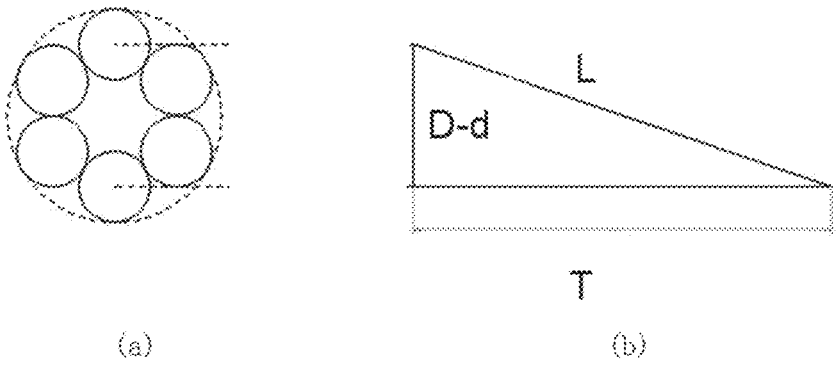
FIG. 14(*a*) and FIG. 14(*b*) are respectively a schematic diagram of untwisted steel wires of the cord and a calculation diagram of the length of the untwisted steel wires.

As shown in FIG. 14(*a*) and FIG. 14(*b*), the length L of the untwisted steel wires of the cord is calculated by:

$$L = \sqrt{T^2 + [\pi (D - d)]^2}$$

Where, T is the twist pitch, D is the diameter of the cord, and the diameter D of an irregular cord is a mean value of the maximum diameter and the minimum diameter of the irregular cord, and d is the diameter of the steel wires.

Similarly, a cord with a 1×n structure, a cord with a 1+n structure or a cord with a layered structure can also be produced by the above method, wherein the number of steel wires in an outermost layer of the cord with the layered structure is n, and n≥5.

Figure 12:
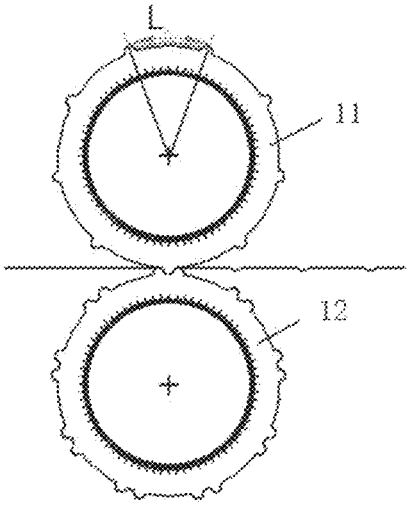
FIG. 12 is a schematic structural diagram of a pair of deformation gears of the deformation device in FIG. 11.

As shown in FIG. 11 which is a schematic diagram of the production method of the flat cord of the invention, steel wires from paying-off units are periodically pre-deformed by the pre-deformation device 1 and then twisted together at a twisting point. FIG. 12 is a schematic structural diagram of one pair of deformation gears (an upper deformation gear 11 and a lower deformation gear 12) of the deformation device 1, and the actual number of pairs of deformation gears can be set according to the number of steel wires to be deformed. Because the positions of the second waveforms of the steel wires of the cord are periodically controlled, the second waveforms on the steel wires are regularly arranged on one side of the cord to form an irregular surface morphology of the cord when the steel wires are twisted to form the cord, and a flat structure is formed on this side when a straightener is used for relieving the stress of the cord later.

Embodiment 3

Based on the steel cord provided in Embodiment 1, the application further provides a tire comprising the steel cord in Embodiment 1.

It can be known, based on technical knowledge, that the invention can also be implemented by other embodiments without departing from the essential spirit or necessary features of the invention. Therefore, in all aspects, the above embodiments are merely illustrative ones rather than unique ones. All variations made within the scope of the invention or its equivalents should be included in the invention.

What is claimed is:

1. A steel cord, being formed by twisting multiple steel wires, wherein at least one of the steel wires has deformations before twisting to allow the cord to have an irregular surface morphology after twisting, the deformations of the at least one of the steel wires are located at positions of a same side of the steel cord along an axial direction of the steel cord, or the deformations of the at least two of the steel wires are located at positions of two symmetrical sides of the steel cord along an axial direction of the steel cord, such that a cross-section of the steel cord has a long axis and a short axis unequal to the long axis.

2. The steel cord according to claim 1, wherein the steel cord is a cord with a 1×n structure, a cord with a 1+n structure or a cord with a layered structure, and the number of steel wires in an outermost layer of the steel cord with the layered structure is n; wherein, n≥5.

3. The steel cord according to claim 2, wherein at least one of unlayed steel wires of the steel cord has a periodic complex waveform, and the periodic complex waveform comprises a first waveform and a second waveform overlaid on the first waveform.

4. The steel cord according to claim 3, wherein in a projection of each of the unlayed steel wires within unit cord length on the cross-section, unsmooth-curves produced by the second waveform are regularly arranged on one same side of the axial direction of the steel cord.

5. The steel cord according to claim 3, wherein within unit twist pitch, the second waveforms of all the unlayed steel wires are sequentially arranged in the axial direction of the steel cord.

6. The steel cord according to claim 3, wherein all the unlayed steel wires of the steel cord have the periodic complex waveform.

7. The steel cord according to claim 1, wherein after unlaying the steel cord formed by twisting the multiple steel wires, at least one of unlayed steel wires, which are stripped from steel cord, of the steel cord has a periodic complex waveform, and the periodic complex waveform comprises a first waveform and a second waveform overlaid on the first waveform.

8. The steel cord according to claim 7, wherein in a projection of each of the unlayed steel wires within unit cord length on the cross-section, curves produced by the second waveform are regularly arranged on one same side of the axial direction of the steel cord.

9. The steel cord according to claim 7, wherein within unit twist pitch, the second waveforms of all the unlayed steel wires are sequentially arranged in the axial direction of the steel cord.

10. The steel cord according to claim 7, wherein all the unlayed steel wires of the steel cord have the periodic complex waveform.

11. The steel cord according to claim 1, wherein an angle of a projection of one of the deformations on the cross-section of the steel cord is $\alpha$, which satisfies $0<\alpha<180°$.

12. The steel cord according to claim 11, wherein the angle of the projection of one of the deformations on the cross-section of the steel cord $\alpha$ satisfies $0<\alpha<120°$.

13. The steel cord according to claim 1, wherein a ratio of the long axis to the short axis is a value larger than 1 and less than 1.546.

14. The steel cord according to claim 13, wherein the ratio of the long axis to the short axis is a value larger than 1 and less than 1.394.

15. A production method of the steel cord according to claim 1, comprising:

before twisting, periodically deforming steel wires to allow the steel wires to have periodic complex waveforms after being twisted; and twisting at least one of the deformed steel wires and other steel wires to form the steel cord with the deformations.

16. A tire, comprising the steel cord according to claim 1.

* * * * *